US005200385A

United States Patent [19]

Inoue et al.

[11] Patent Number: 5,200,385

[45] Date of Patent: Apr. 6, 1993

[54] THERMOSENSITIVE RECORDING MATERIAL

[75] Inventors: Hiroaki Inoue, Fuji; Norihiko Inaba; Hiroaki Okuda, both of Numazu; Koji Yamamoto, Fuji, all of Japan

[73] Assignee: Ricoh Company, Ltd., Tokyo, Japan

[21] Appl. No.: 449,004

[22] Filed: Dec. 12, 1989

[30] Foreign Application Priority Data

Dec. 20, 1988 [JP] Japan ..... 63-322378
Nov. 2, 1989 [JP] Japan ..... 1-286886

[51] Int. Cl.[5] ..... B41M 5/26
[52] U.S. Cl. ..... 503/209; 503/225
[58] Field of Search ..... 503/209, 225

[56] References Cited

U.S. PATENT DOCUMENTS 4,363,664 12/1982 Delaney ..... 503/209

FOREIGN PATENT DOCUMENTS 3623483 1/1987 Fed. Rep. of Germany .
3628237 2/1987 Fed. Rep. of Germany .
3700299 7/1987 Fed. Rep. of Germany .

OTHER PUBLICATIONS

McCutcheon's Emulsifiers & Detergents, 1982, p. 297.

Tensid-Taschenbuch, Dr. H. Stache, 2. Auflage, 1981, Carl Hanser Verlag, Seiten 150 bis 153.

*Primary Examiner*—Pamela R. Schwartz
*Attorney, Agent, or Firm*—Oblon, Spivak, McClelland, Maier & Neustadt

[57] ABSTRACT

A thermosensitive recording material comprising a leuco dye, a color developer and a water-soluble lubricant such as an alkylphosphate compound having formula (I) or (II):

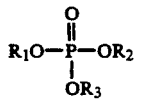

(I)

wherein $R_1$, $R_2$ and $R_3$ each independently are an alkyl group, an alkynyl group or a monovalent metallic element, but they cannot be the metallic element at the same time; or

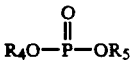

(II)

wherein $R_4$ is an alkyl group or an alkynyl group, and $R_5$ is a monovalent metallic element.

8 Claims, No Drawings

THERMOSENSITIVE RECORDING MATERIAL

BACKGROUND OF THE INVENTION

1. Field of the Invention

This invention relates to a thermosensitive recording material, and more particulary to a thermosensitive recording material utilizing a coloring reaction between a leuco dye and a color developer capable of inducing color formation in the leuco dye upon application of heat thereto.

2. Discussion of Background

Recently, various information recording materials of a non-enviromental-pollution type, capable of nursing resources and economizing energy, have been developed and put to practical use for the purpose of dealing with a great variety of abundant information. In particular, thermosensitive recording materials have been widely employed in various fields, for instance, for use with terminal printers for computers and calculators, recorders for medical measurement instruments, low- and high-speed facsimile apparatus, automatic ticket vending apparatus, copying machines, and label printing machines for the POS system, because of the following advatages thereof:

(1) images can be readily recorded on a thermosensitive recording material by simply applying heat thereto without employing a complicated development process;

(2) a relatively simple and small-sized apparatus is available for preparing a thermosensitive recording material, handling of the recording material is easy, and the maintenance cost of the same is inexpensive; and (3) in the case where paper, which is not costly as compared with other materials, is used as a support, a thermosensitive recording material with the plain paper-like touch is obtainable.

In general, the thermosensitive recording material is prepared by coating a liquid for forming a thermosensitive coloring layer, which contains a coloring component capable of inducing color formation upon application of heat thereto, onto the surface of paper, synthetic paper or a plastic film, and then dried. Images are recorded on the recording material thus prepared by a thermal pen or a thermal head.

The thermosensitive recording materials have the above-desribed advantages, and yet they are disadvantageous in that they readily develop color when they are pressed or heated by friction. Such color development brings about fogging, and the image quality is thus drastically deteriorated.

In particular, thermosensitive recording materials having high sensitivity are now being developed aiming at reducing the amount of electric power consumed by a facsimile apparatus, a printer or the like, and prolonging the life span of the thermal head. Owing to the high sensitivity, these recording materials develop color more easily than the conventional ones when they are pressed or heated frictionally.

In order to improve the above problem, a specific material having color-fading characteristics has been incorporated into a thermosensitive recording material as disclosed in Japanese Patent Publications 57-59078, 57-18517 and 60-21552. This material can fade color once developed in the recording material. The recording material containing such a material, however, cannot be preserved for a prolonged period of time.

Japanese Patent Publication 50-14531 discloses a thermosensitive recording material containing a wax by which the recording material can be protected from developing color by scratching. This recording material, however, cannot sufficiently withstand frictional pressure, and is poor in matching characteristics.

A non-aqueous alkylphosphate compound has been proposed in Japanese Laid-Open Patent Application 62-149478. It is however unfavorable to incorporate this compound into a thermosensitive recording material having extremely high sensitivity, which has been developed so as to fulfill rescent various demands, for example, for high-speed printing. This is because if a coloring agent having extremely high sensitivity exists in a thermosensitive layer together with the non-aqueous alkylphosphate compound, the coloring agent develops color before the alkylphosphate compound reveals its effect.

SUMMARY OF THE INVENTION

Accordingly, it is an object of the present invention to provide a thermosensitive recording material utilizing a coloring reaction between a leuco dye and a color developer capable of inducing color formation in the leuco dye upon application of heat thereto, which the recording material has extremely high sensitivity and hardly causes fogging even when it is pressed or heated by friction.

The object of the present invention can be attained by a thermosensitive recording material comprising a substrate, and a thermosensitive recording layer formed thereon, which comprises a leuco dye, a color developer capable of inducing color formation in said leuco dye upon application of heat thereto, and a water-soluble lubricant.

DETAILED DESCRIPTION OF THE PREFERRED EMBODIMENTS

Since the thermosensitive recording materials according to the present invention comprise a water-soluble lubricant, they have extremely high sensitivity, and hardly cause fogging even when they are pressed or heated by friction. This is because the recording materials comprising the water-soluble lubricant have a very smooth surface.

The lubricant which is used in the present invention is water soluble, so that it can be homogeneously dissolved, for example, in a coating liquid used for forming a thermosensitive recording layer. Therefore, particles of the non-aqueous coloring agent contained in the coating liquid are covered with the water-soluble lubricant. The recording material containing the coloring agent coated with the lubricant does not easily develop color even when it is pressed of frictionally heated, and fogging of the recording material is thus prevented.

Furthermore, the water-soluble lubricant can be homogeneouly dissolved in any coating liquids such as a coating liquid for forming an undercoat layer, a coating liquid for forming a thermosensitive coloring layer and a coating liquid for forming an overcoat layer, so that layers in which the lubricant is homogeneously dispersed can be obtained by drying the liquids after coating.

The water-soluble lubricant can be incorporated into any constituent layers of the thermosensitive recording material. It is, however, preferable to incorporate the lubricant into a thermosensitive coloring layer. This is because particles of both the leuco dye and the color developer contained in the thermosensitive coloring layer are coated with the lubricant, so that the coloring reaction between the leuco dye and the color developer, which is initiated by pressure or frictional heat, can be successfully prevented.

Polymeric surface active agents and anionic surface active agents can be used in the present invention as the water-soluble lubricant. However, there is no specific limitation as to the water-soluble lubricant used.

Specific examples of the polymeric surface active agent include polyester emulsions such as "TRL-30" (Trademark) made by Matsumoto Yushi-Seiyaku Company, Ltd., and specific examples of the anionic surface active agent include alkylphosphate compounds such as "TRL-20" (Trademark) made by Matsumoto Yushi-Seiyaku Company, Ltd.

Of these, the alkylphosphate compound is preferred because it can impart a high degree of slippage to the surface of the thermosensitive recording material.

The alkylphosphate compounds which can be used in the present invention are those having the following formulae (I) and (II):

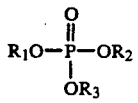

(I)

wherein $R_1$, $R_2$ and $R_3$ each independently are an alkyl group, an alkynyl group or a monovalent metallic element, but they cannot be the metallic element at the same time; and

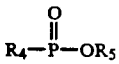

(II)

wherein $R_4$ is an alkyl group or an alkynyl group, and $R_5$ is a monovalent metallic element.

The alkylphosphate compounds can be employed either singly or in combination.

The alkyl group indicated by $R_1$, $R_2$, $R_3$ or $R_4$ is a linear or branched alkyl group having 3 to 24 carbon atoms, preferably 10 to 14 carbon atoms.

The monovalent metallic element indicated by $R_1$, $R_2$, $R_3$ or $R_5$ is Na, K or Ca, preferably K.

Specific examples of the alkylphosphate compound used in the present invention include potassium laurylphosphate, sodium laurylphospahte, potassium caprylphosphate, sodium caprylphosphate, potassium undecalphosphate and sodium undecalphospahte.

The amount of the water-soluble lubricant is 0.0001 to 10.0 g/m$^2$, preferably 0.0001 to 5.0 g/m$^2$.

The water-soluble lubricant can be incorporated into any layers of any type of thermosensitive recording materials such as a thermosensitive recording material in which a thermosensitive coloring layer is formed on a substrate, a thermosensitive recording material in which an undercoat layer and a thermosensitive coloring layer are successively overlaid on a substrate in this order, and a thermosensitive recording material in which an undercoat layer, a thermosensitive coloring layer and an overcoat layer are successively overlaid on a substrate in this order.

In the case where the undercoat layer, the thermosensitive coloring layer or the overcoat layer is composed of two or more layers laminated, the lubricant can be incorporated into either only one of the laminated layers or two or more of the laminated layers.

Moreover, it is also acceptable to form a top coat layer comprising the water-soluble lubricant on the surface of the thermosensitive recording material.

In the present invention, the undercoat layer, the thermosensitive coloring layer, the overcoat layer and the top coat layer are referred to as constituent layers of a thermosensitive recording layer formed on the substrate. The thermosensitive recording layer at least comprises the thermosensitive coloring layer, and may further comprise any of the other layers, if necessary.

Any leuco dyes which are used in the conventional thermosensitive recording materials can be used in this present invention.

Specific examples of the leuco dyes include triphenyl methane type leuco compounds, fluorane type leuco compounds, phenothiadine leuco compounds, Auramine type leuco compounds, spiropyran type leuco compounds, and indolinophthalide type leuco compounds. These leuco dyes are used singly or in combination. Specific examples of the leuco dyes are as follows:

3,3-bis(p-dimethylaminophenyl)phthalide,
3,3-bis(p-dimethylaminophenyl)-6-dimethylaminophthalide (=Crystal Violet lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-(N-methyl-N-isobutylamino)-6-methyl-7-anilinofluoran,
3-(N-ethyl-N-isoamylamino)-6-methyl-7-anilinofluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyridino-6-methyl-7-anilinofluoran,
2-{N-(3'-trifluoromethylphenyl)amino}-6-diethylaminofluoran,
2-{3,6-bis(diethylamino)-9-(o-chloroanilino)xanthyllactam benzoate},
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-diethylamino-6-methyl-7-(2',4'-dimethylanilino)fluoran,
3-(N,N-diethylamino)-5-methyl-7-(N,N-dibenzylamino)-fluoran,
benzoyl leuco Methylene Blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide, 3-morpholino-7-(N-propyl-trifluoromethylanilino)-fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylamino-fluoran,
3-diethylamino-5-chloro-7-(α-phenylethylamino)-fluoran,
3-(N-ethyl-p-toluidino)-7-(α-phenylethylamino)-fluoran,
3-diethylamino-7-(o-methoxycarbonylphenylamino)-fluoran,
3-diethylamino-5-methyl-7-(α-phenylethylamino)-fluoran,
3-diethylamino-7-piperidinofluoran,
2-chloro-3-(N-methyltoluidino)-7-(p-n-butylanilino)-fluoran,
3-(N-methyl-N-isopropylamino)-6-methyl-7-anilino-fluoran,
3-dibutylamino-6-methyl-7-anilinofluoran,
3,6-bis(dimethylamino)fluorene spiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-N-ethyl-N-(2-ethoxypropyl)amino-6-methyl-7-anilinofluoran,
3-N-ethyl-N-tetrahydrofurfurylamino-6-methyl-7-anilinofluoran,
3-diethylamino-6-methyl-7-mesidino-4',5'-benzofluoran,
3-(p-dimethylaminophenyl)-3-{1,1-bis(p-dimethylaminophenyl)ethylene-2-il}phthalide,
3-(p-dimethylaminophenyl)-3-{1,1-bis(p-dimethylaminophenyl)ethylene-2-il}-6-dimethylaminophthalide,
3-(p-dimethylaminophenyl)-3-(1-p-dimethylamino-phenylethylene-2-il)phthalide,
3-(p-dimethylaminophenyl)-3-(1-p-dimethylaminophenyl-1-p-chlorophenylethylene-2-il)-6-dimethylaminophthalide,
3-(4'-dimethylamino-2'-methoxy)-3-(1''-p-dimethylaminophenyl-1''-p-chlorophenyl-1'',3''-butadiene-4''-il)-benzophthalide,
3-(4'-dimethylamino-2'-benzyloxy)-3-(1''-p-dimethylaminophenyl-1''-phenyl-1'',3''-butadiene-4''-il)benzophthalide,
3-dimethylamino-6-dimethylamino-fluorene-9-spiro-3'-(6'-dimethylamino)phthalide,
3,3-bis{2-(p-dimethylaminophenyl)-2-(p-methoxyphenyl)-ethenyl}-4,5,6,7-tetrachlorophthalide,
3-bis(1,1-bis(4-pyrrolidinophenyl)ethylene-2-il}-5,6-dichloro-4,7-dibromophthalide, and
bis(p-dimethylaminostylyl)-1-naphthalenesulfonylmethane.

In the recording material of the present invention, various electron accepting compounds such as phenolic compounds, thiophenolic compounds, thiourea derivatives, organic acids and metal salts thereof are used as the color developer.

Specific examples of such electron accepting compounds are as follows:

4,4'-isopropylidene bisphenol,
4,4'-isopropylidene bis(o-methylphenol),
4,4'-sec-butylidene bisphenol,
4,4'-isopropylidene bis(2-tert-butylphenol),
4,4'-cyclohexylidene diphenol,
4,4'-isopropylidene bis(2-chlorophenol),
2,2'-methylene bis(4-methyl-6-tert-butylphenol),
2,2'-methylene bis(4-ethyl-6-tert-butylphenol),
4,4'-methylene bis(oxyethylenethio)diphenol,
4,4'-butylidene bis(6-tert-butyl-2-methylphenol),
1,1,3-tris(2-methyl-4-hydroxy-5-tert-butylphenyl)-butane,
1,1,3-tris(2-methyl-4-hydroxy-5-cyclohexylphenyl)-butane,
4,4'-thiobis(6-tert-butyl-2-methylphenol),
4,4'-thiobis(6-tert-butyl-3-methylphenol),
4,4'-diphenolsulfone,
4,2'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,5-di(4-hydroxyphenylthio)-3-oxapentane,
1,3-bis(4-hydroxyphenylthio)propane,
1,3-bis(4-hydroxyphenylthio)-2-hydroxypropane,
1,1-bis(4-hydroxyphenyl)cyclohexane,
N,N'-diphenylthiourea,
N,N'-di(m-chlorophenyl)thiourea,
salicylanilide,
5-chloro-salicylanilide,
bis-(4-hydroxyphenyl)acetic methylacetate,
bis-(4-hydroxyphenyl)acetic benzylacetate,
1,3-bis(4-hydroxycumyl)benzene,
1,4-bis(4-hydroxycumyl)benzene,
2,4'-diphenolsulfone,
2,2'-diallyl-4,4'-diphenolsulfone,
3,4-dihydroxy-4'-methyldiphenylsulfone,
4,4-dihydroxyphenylsulfone,
zinc 1-acetyloxy-2-naphthoate,
zinc 2-acetyloxy-1-naphthoate,
zinc 2-acetyloxy-3-naphtoate,
α,α-bis(4-hydroxyphenyl)-α-methyltoluene,
antipyrine complexes of zinc thiocyanate,
tetrabromobisphenol A, and
tetrabromobisphenol S.

The thermosensitive recording material according to the present invention can be prepared by applying the leuco dye, the color developer and the water-soluble lubricant, together with a binder agent, to a substrate.

As the binder agent, the following compounds, which have conventionally been used as a binder, can be used: polyvinyl alcohol; starch and derivatives thereof; cellulose derivatives such as methoxycellulose, hydroxyethylcellulose, carboxymethyl cellulose, methyl cellulose and ethyl cellulose; water-soluble polymers such as sodium polyacrylate, polyvinyl pyrrolidone, a copolymer of acrylamide and acrylate, a copolymer of acrylamide, acrylate and methacrylate, alkaline salts of a copolymer of styrene and maleic anhydride, alkaline salts of a copolymer of isobutylene and maleic anhydride, polyacrylamide, sodium alginate, gelatin and casein; emulsions such as of polyvinyl acetate, polyurethane, polyacrylate, polymethacrylate, a copolymer of vinylchloride and vinyl acetate and a copolymer of ethylene and vinylacetate; and latices such as of a copolymer of styrene and butadiene and a copolymer of styrene, butadiene and acrylate.

Various thermofusible materials may be incorporated into the thermosensitive recording material of the present invention so as to improve the thermosensitivity. Examples of such thermofusible materials include fatty acids such as stearic acid and behenic aicd; fatty acid amides such as stearic acid amide and palmitic acid amide; metal salts of fatty acid such as zinc stearate, aluminum stearate, calcium stearate, zinc palmitate and zinc behenate; and organic compounds such as p-benzylbiphenyl methane, p-benzyltertphenyl methane, p-benzyltriphenyl methane, p-benzyloxy benzylbenzoate, β-benzyloxy naphtharene, β-naphthoic acid phenyl ester, 1-hydroxy-2-naphthoic acid phenyl ester, 1-hydroxy-2-naphthoic acid methyl ester, diphenyl carbonate, terephthalic acid dibenzyl ester, terephthalic acid dimethyl ester, 1,4-dimethoxynaphtharene, 1,4-diethoxynaphtharene, 1,4-dibenzyl oxynaphtharene, 1,2-bis(phenoxy)ethane, 1,2-bis(3-methylphenoxy)ethane, 1,2-bis(4-methylphenoxy)ethane, 1,4-bis(phenoxy)butane, 1,4-bis(phenoxy)-2-butene, 1,2-bis(4-methoxyphenylthio)ethane, dibenzoyl methane, 1,4-bis(phenylthio)butane, 1,4-bis(phenylthio)-2-butene, 1,2-bis4-methoxyphenylthio)ethane, 1,3-bis(2-vinyloxyethoxy)benzene, 1,4-bis(2-vinyloxyethoxy)benzene, p-(2-vinyloxyethoxy)biphenyl, p-aryloxybiphenyl, p-propargyl oxybiphenyl, dibenzoyl oxymethane, 1,3-dibenzoyl oxypropane, dibenzyl disulfide, 1,1-diphenyl ethanol, 1,1-diphenyl propanol, p-(benzyloxy)benzylalcohol, 1,3-diphenoxy-2-propanol, N-octadecyl carbamoyl-p-methoxycarbonyl benzene, and N-octadecyl carbamoyl benzene.

Auxiliary components such as fillers and surface active agents which are commonly used for the conventional thermosensitive recording materials may be employed, if necessary, in the thermosensitive recording material according to the present invention.

As the fillers, fine powder of inorganic materials such as of calcium carbonate, silica, zinc oxide, titanium oxide, aluminum hydroxide, zinc hydroxide, barium sulfate, clay, talc, surface-treated calcium, and surface-treated silica; and fine powder of organic materials such as of urea-formalin resin, a copolymer of styrene and methacylic acid, and polystyrene resin can be used.

The thermosensitive recording materials according to the present invention comprise the water-soluble lubricant, so that they have extremely high sensitivity and hardly cause fogging even when they are pressed or heated by friction. In particular, in the case where the alkylphosphate compound having formula (I) or (II) is employed as the water-soluble lubricant, the slippage of the surface of the thermosen-sitive recording material can be remarkably improved.

Other feature of this invention will become apparent in the course of the following description of exemplary embodiments, which are given for illustration of the invention and are not intended to be limiting thereof.

EXAMPLE 1

Preparation of Dispersion A

The following components were placed in a ball mill pot, and thoroughly dispersed to obtain Dispersion A containing fine particles with an average size of 2 to 3 μm.

| | parts by weight |
|---|---|
| 3-(N-methyl-N-cyclohexyl)amino-6-methyl anilinofluoran | 20 |
| 10% aqueous polyvinylalcohol solution | 20 |
| Water | 60 |
| Total | 100 |

Preparation of Dispersion B

The following components were placed in a ball mill pot, and thoroughly dispersed to obtain Dispersion B containing fine particles with an average size of 2 to 3 μm.

| | parts by weight |
|---|---|
| 1,5-di(4'-hydroxyphenylthio)-3-oxapentane | 20 |
| Calcium carbonate | 20 |
| Zinc stearate | 10 |
| 10% aqueous polyvinylalcohol solution | 20 |
| Water | 80 |
| Total | 150 |

Preparation of Thermosensitive Recording Material

Ten parts by weight of Dispersion A, 40 parts by weight of Dispersion B, and 5 parts by weight of potassium laurylphosphate (Trademark "TRL-20", an alkylphosphate compound made by Matsumoto Yushi-Seiyaku Company, Ltd.) were thoroughly mixed to obtain Liquid No. 1 for forming a thermosensitive coloring layer.

Liquid No. 1 was coated onto a sheet of high quality paper with a basis weight of 50 g/m$^2$, and then dried. The coated amount was 4 to 5 g/m$^2$ (dry basis). The surface of the above-obtained thermosensitive coloring layer was calendered. Thus, thermosensitive recording material No. 1 according to the present invention was obtained, which had a surface smoothness of 500 to 600 sec.

EXAMPLE 2

The procedures in Example 1 was repeated except that the potassium laurylphosphate (alkylphosphate compound) used for preparing Liquid No. 1 was eliminated, whereby Liquid No. 2 for forming a thermosensitive coloring layer was prepared.

Liquid No. 2 was coated onto a sheet of high quality paper in the same manner as in Example 1 to form a thermosensitive coloring layer.

An aqueous solution of potassium laurylphosphate (Trademark "TRL-20", Matsumoto Yushi-Seiyaku Company, Ltd.) in an amount of 0.5 g/m$^2$ (dry basis) was coated onto the thermosensitive coloring layer, and then dried to form a top coat layer. The surface of the top coat layer was calendered. Thus, thermosensitive recording material No. 2 according to the present invention was obtained, which had a surface smoothness of 500 to 600 sec.

COMPARATIVE EXAMPLE 1

Example 1 was repeated except that the potassium laurylphosphate (alkylphosphate compound) used for preparing Liquid No. 1 was eliminated, whereby comparative thermosensitive recording material No. 1 was prepared.

COMPARATIVE EXAMPLE 2

Example 1 was repeated except that 5 parts by weight of the potassium laurylphosphate (alkylphosphate compound) used for preparing Liquid No. 1 was replaced by 5 parts by weight of zinc stearate, whereby comparative thermosensitive recording material No. 2 was prepared.

COMPARATIVE EXAMPLE 3

Example 1 was repeated except that 5 parts by weight of the potassium laurylphosphate (alkylphosphate compound) used for preparing Liquid No. 1 was replaced by 5 parts by weight of calcium bis(distearylphosphate), whereby comparative thermosensitive recording material No. 3 was prepared.

The above-prepared thermosensitive recording materials Nos. 1 and 2 according to the present invention, and comparative thermosensitive recording materials Nos. 1 to 3 were evaluated by the following methods.

Dynamic Coloring Density

Each recording material was loaded in a facsimile apparatus (GIII) which had a thermal head of 8 dots/mm (made by Matsushita Electronic Components Co., Ltd.) and a heating element of approximately 400 Ω/dot, and images were printed under the following conditions:

| | |
|---|---|
| Recording speed in the main-scanning direction: | 20 msec/line |
| Line density in the sub-scanning direction: | 3.85 line/mm |
| Platen pressure: | 1.4 kg/cm$^2$ |
| Input power to thermal head: | 0.4 W/dot |
| Application time for electric current: | 1.0 msec, 1.4 msec, and 1.8 msec. |

The density of the printed image was measured by a Macbeth Densitometer "RD-914" (a filter loaded: "Wratten-106"). The results are shown in Table 1.

Fogging

In order to evaluate the anti-fogging characteristics, the surface of each recording material was rubbed by a nail. The recording materials were then visually observed. The results are shown in Table 1.

TABLE 1

| Recording Material | Dynamic Color Density 1.0 msec | 1.4 msec | 1.8 msec | Color Formation by Friction |
|---|---|---|---|---|
| No. 1 | 0.85 | 1.22 | 1.35 | O |
| No. 2 | 0.84 | 1.22 | 1.34 | OO |
| Comp. No. 1 | 0.85 | 1.23 | 1.35 | XX |
| Comp. No. 2 | 0.74 | 1.12 | 1.33 | X |

TABLE 1-continued

| Recording Material | Dynamic Color Density 1.0 msec | 1.4 msec | 1.8 msec | Color Formation by Friction |
|---|---|---|---|---|
| Comp. No. 3 | 0.84 | 1.21 | 1.34 | X |

Note)
"OO": observed almost no color formation
"O": observed slight color formation
"X": observed color formation
"XX": observed considerable color formation The data shown in Table 1 demonstrates that the thermosensitive recording materials according to the present invention have high sensitivity, and hardly cause fogging even when they are pressed or heated by friction.

What is claimed is:

1. A thermosensitive recording material comprising a substrate, and a thermosensitive recording layer formed thereon, which comprises:
   - a leuco dye;
   - a color developer capable of inducing color formation in said leuco dye upon application of heat thereto, and
   - a water-soluble lubricant, wherein said water-soluble lubricant is an alkylphosphate anionic surface active agent.

2. The thermosensitive recording material as claimed in claim 1, wherein said alkylphosphate compound has the following formula (I):

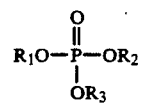

(I)

wherein $R_1$, $R_2$ and $R_3$ each independently are an alkyl group, an alkynyl group or a monovalent metallic element, but they cannot be the metallic element at the same time.

3. The thermosensitive recording material as claimed in claim 2, wherein said alkyl group is a linear or branched alkyl group having 3 to 24 carbon atoms.

4. The thermosensitive recording material as claimed in claim 2, wherein said monovalent metallic element is Na, K or Ca.

5. The thermosensitive recording material as claimed in claim 1, wherein said alkylphosphate compound has the following formula (II):

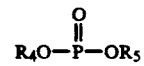

(II)

wherein $R_4$ is an alkyl group or an alkynyl group, and $R_5$ is a monovalent metallic element.

6. The thermosensitive recording material as claimed in claim 5, wherein said alkyl group is a linear or branched alkyl group having 3 to 24 carbon atoms.

7. The thermosensitive recording material as claimed in claim 5, wherein said monovalent metallic element is Na, K or Ca.

8. The thermosensitive recording material as claimed in claim 1, wherein said alkylphosphate compound is selected from the group consisting of potassium laurylphosphate, sodium laurylphosphate, potassium caprylphosphate, sodium caprylphosphate, potassium undecalphosphate and sodium undecalphosphate.

* * * * *

UNITED STATES PATENT AND TRADEMARK OFFICE

CERTIFICATE OF CORRECTION

PATENT NO. : 5,200,385

DATED : APRIL 6, 1993

INVENTOR(S) : HIROAKI INOUE ET AL

It is certified that error appears in the above-indentified patent and that said Letters Patent is hereby corrected as shown below:

Column 2, line 56, "homogeneouly" should read --homogeneously--.

Column 3, line 48, "laurylphospahte" should read --laurylphosphate--.

Signed and Sealed this

Sixteenth Day of August, 1994

Bruce Lehman

*Attest:*

BRUCE LEHMAN

*Attesting Officer*

*Commissioner of Patents and Trademarks*